United States Patent [19]

Austin

[11] 4,413,622

[45] Nov. 8, 1983

[54] OXYGEN MANIFOLD SYSTEM

[75] Inventor: Stephen D. Austin, Sandwich, Mass.

[73] Assignee: AMM Incorporated, Sandwich, Mass.

[21] Appl. No.: 333,373

[22] Filed: Dec. 22, 1981

[51] Int. Cl.[3] ..... A62B 7/00

[52] U.S. Cl. ..... 128/205.25; 128/202.13; 128/202.27; 128/205.24; 222/3

[58] Field of Search ..... 128/202.27, 204.18, 128/205.24, 205.25, 204.26, 205.17, 205.22, 128/200.24, 200.19, 202.13; 222/3, 6

[56] References Cited

U.S. PATENT DOCUMENTS

| | | | |
|---|---|---|---|
| 428,592 | 5/1896 | Chapman | 128/202.13 |
| 2,490,839 | 12/1949 | Shaffer et al. | 48/190 |
| 3,831,599 | 8/1974 | Needham | 128/205.12 |
| 4,165,738 | 8/1979 | Graves et al. | 128/205.25 |

FOREIGN PATENT DOCUMENTS

| | | | |
|---|---|---|---|
| 1004291 | 11/1951 | France | 128/202.13 |
| 793452 | 4/1958 | United Kingdom | 128/205.25 |

*Primary Examiner*—Henry J. Recla
*Assistant Examiner*—Karin M. Reichle
*Attorney, Agent, or Firm*—Wegner & Bretschneider

[57] ABSTRACT

There is disclosed a portable oxygen delivery system for use by a plurality of patients having a source of oxygen, at least one tube with capped ends to form an air-tight member and a plurality of valves connected to the tube. The valves are connected to the source of oxygen or medical oxygen applicators.

12 Claims, 6 Drawing Figures

FIG.3
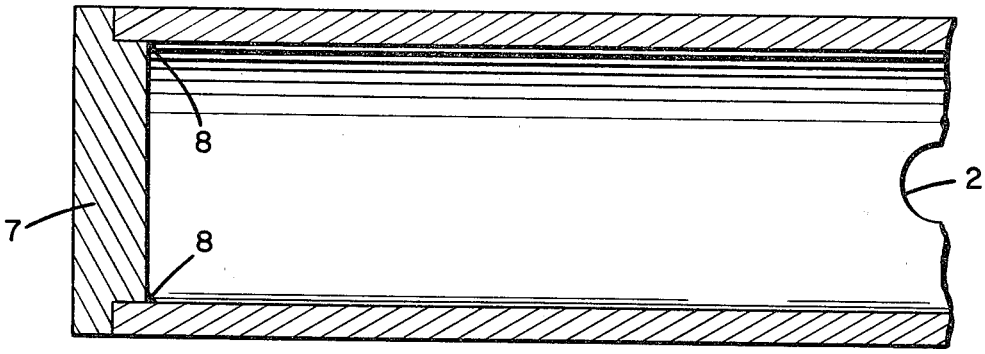
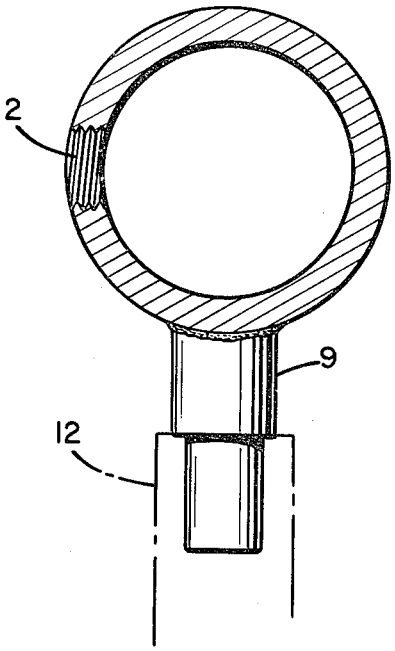
FIG. 2
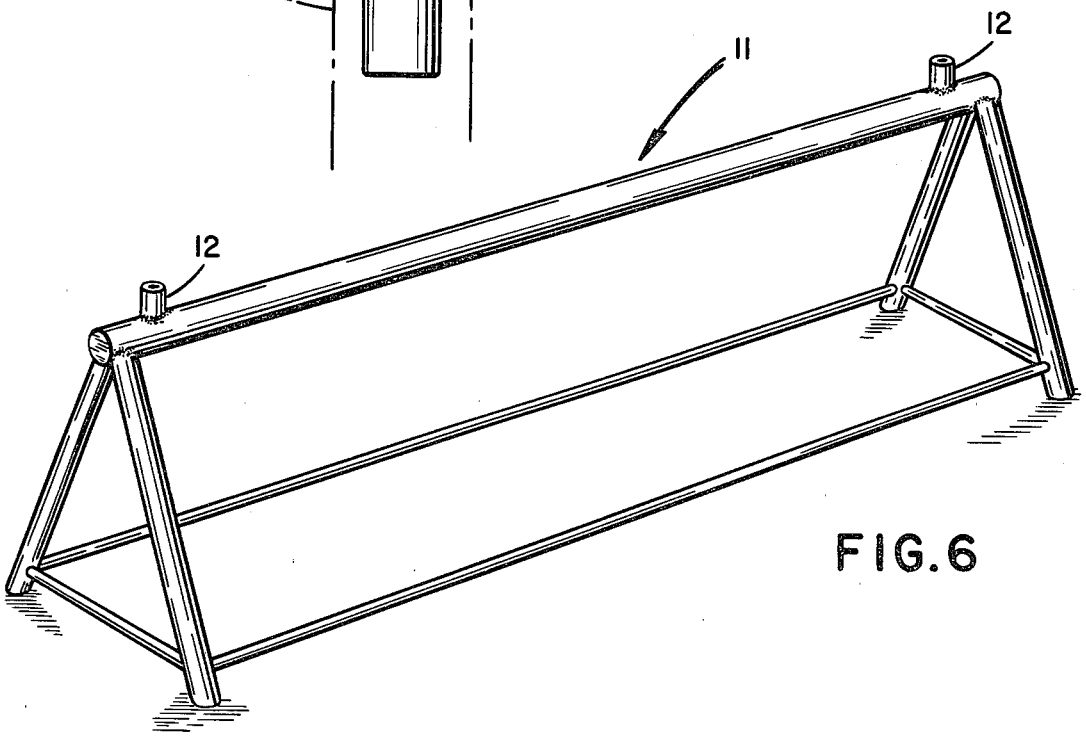
FIG.6

OXYGEN MANIFOLD SYSTEM

BACKGROUND OF THE INVENTION

This invention relates to a portable oxygen delivery system for use in medical emergencies. When natural or other disasters such as floods, earthquakes, fires, collapsing buildings, etc., occur, there often arises a need for administration of oxygen to many people in out-of-the-way locations. Administration of oxygen may be required at the scene of the disaster, or at disaster victim centers, such as converted school buildings, where permanent medical facilities for numerous patients are not available. At the present, this need is being partially met by the use of numerous portable oxygen tanks whereby one person is treated with one tank, and the victims take turns at the tanks in the event that an insufficient number of tanks is available.

An object of the present invention is to provide an oxygen manifold system by which several persons can be treated medically with oxygen at the same time.

A further object of the invention is to provide such an emergency oxygen manifold system which is portable and may be easily delivered to any site where it is needed.

A further object of the invention is to provide such a portable medical oxygen manifold system which may be supplied with one or more portable oxygen tanks.

An additional object of the invention is to provide a manifold to be used for respiratory care in the intensive care ward or the coronary care ward of a hospital.

Yet another object of the invention is to provide a manifold to power various oxygen apparatus.

A further object of the invention is to provide a manifold useful as a back-up oxygen system in a hospital in case of malfunction of the main oxygen system.

Another object of the invention is to provide a manifold for delivery of oxygen in a secondary triage area.

Further objects of this invention, as well as its construction, arrangement and operation, will be apparent from the following description and claims in connection with the accompanying drawings.

THE PRIOR ART

No portable oxygen manifold systems for use in medical emergencies are known to exist in the prior art. Although U.S. Pat. No. 2,490,839 to C. Shaffer et al. discloses a portable manifold gas delivery system, this system is quite distinct from the present invention. The Shaffer et al. patent relates to oxyacetylene welding equipment, and manifold and hose stands therefor. Furthermore, the Shaffer et al. device is a relatively complex system with separate manifolds for the oxygen and acetylene which are attached at the end of each manifold tube-one a gas inlet and one a gas outlet with a shutcock for use of the devices in series. The manifold tubes are permanently attached to a bulky frame which is particularly adapted to use with oxyacetylene hoses. This frame is wheeled, highlighting the limited portability of the Shaffer et al. device over unpredictable terrain. Also, this patent specifically teaches away from the use of portable gas tanks with it; in fact, an important reason for the Shaffer et al. invention was apparently to avoid the need for and use of portable gas tanks. Although the present invention also teaches away from the use of multiple oxygen tanks in an emergency situation, it does require the use of a few such portable tanks.

The Shaffer et al. invention is not portable over long or unpredictable distances.

U.S. Pat. No. 1,574,549 to H. W. Bieshar discloses a manifold air delivery system. This system is not at all portable and is intended for use as a tire pump in service stations, a field of use which is quite remote from that of the emergency medical oxygen delivery system of the present invention.

U.S. Pat. No. 3,459,221 to H. R. Axelrod discloses a manifold assembly for introduction of air into aquariums. It involves a series of valves, the closing of any of which will shut off the air supply to the remaining valves in the series. Such a system would be extremely impracticable in a portable emergency oxygen delivery system where the oxygen recipients/disaster victims might need to be removed from the system in any order. This patent does not suggest any of the specific features of the present invention or use of a manifold gas delivery system in the relevant medical field.

Finally, U.S. Pat. No. 3,477,469 to H. W. Paley is involved in the field of medical technology. However, it only discloses a complex manifold system with built-in valves for use in delivering medical fluid to patients. However, this patent does not suggest numerous important features of the present invention, such as its use for oxygen delivery in remote disaster locations, legs for self-support or attachment to a frame, the ends of the manifold tube closed and sealed in an airtight manner, etc. Thus although this one patent is in the same general field of medical technology, it does not suggest either the functions or embodiments of the present invention.

SUMMARY OF THE INVENTION

The oxygen manifold system of this invention comprises at least one tubular portion with its ends capped, and with a number of holes in a spaced relationship to one another along one side thereof. This tubular portion has one leg attached at each end, and these legs may be securable to a frame or may terminate in feet by which the tubular portion may be firmly supported. Valves may be attached at the holes in the tubular portion, one or more these valves being used for oxygen input, and at least one of the remaining valves being used for oxygen delivery.

THE DRAWINGS

FIG. 2 is a cross sectional view of another embodiment of the invention showing an internally threaded hole and a different type of leg.

FIG. 3 is a partial side view of one end of an embodiment of the invention showing the detail of an end cap.

FIG. 6 is a perspective view of one embodiment of a frame (based upon a triad) to which the main body of the invention may be attached.

DETAILED DESCRIPTION OF THE PREFERRED EMBODIMENTS

Figure 1:
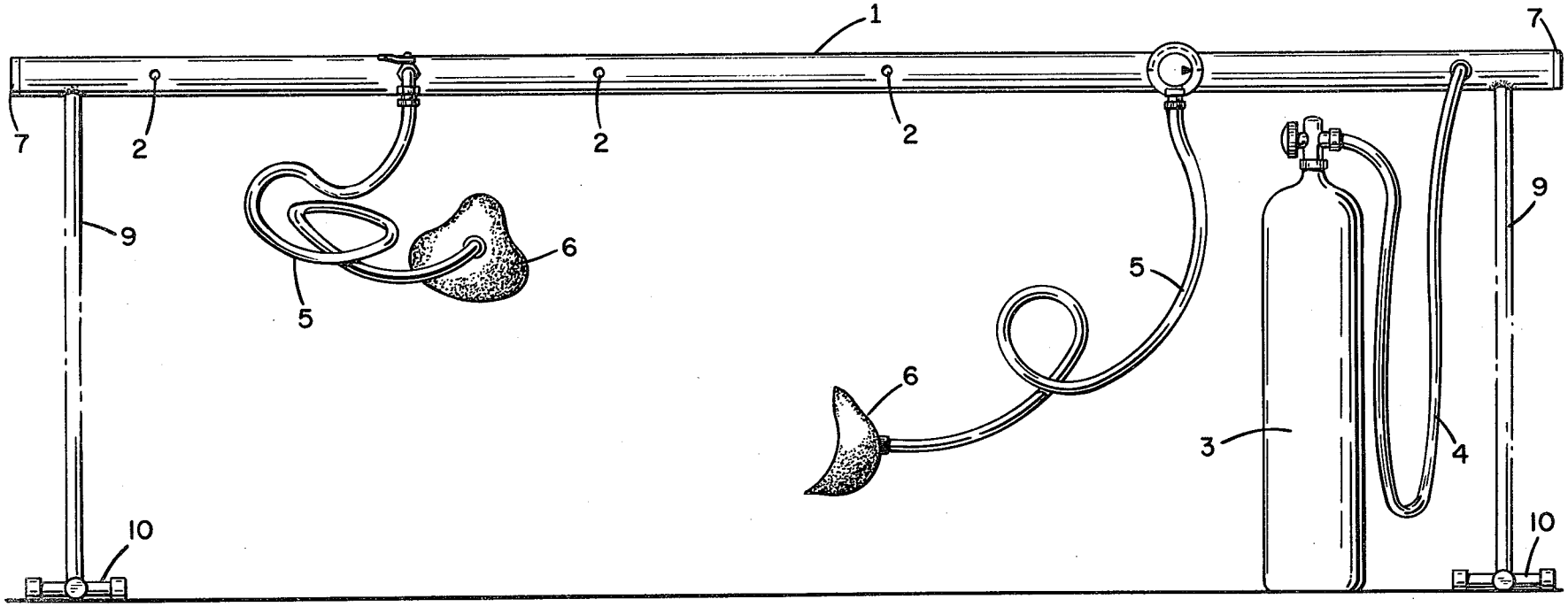
FIG. 1 is a side view of an embodiment of the invention including legs with feet.
Figure 5:
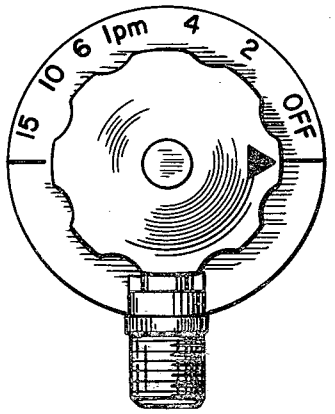
FIG. 5 is a view of a constant flow selector valve which may be included in the invention.
Figure 4:
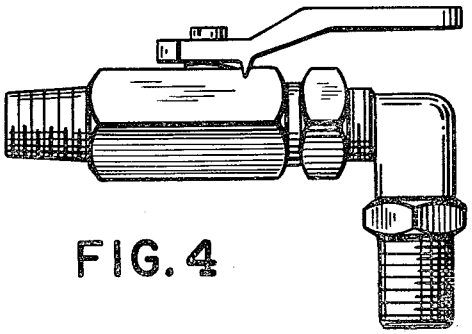
FIG. 4 is a view of one type of externally threaded elbow valve which may be included in the invention.

The main body of the device of the invention consists of a single elongated hollow tube 1. This tube may be comprised of a metal, preferably stainless steel, or of a durable plastic or other material. This tube has a number of holes 2 located in spatial relationship to one another along one side of it. An inlet or outlet valve (FIGS. 4 and 5) is attached to the tube 1 at each hole 2. The dimensions of the tube 1 may be determined by the number of oxygen outlets to be provided by the tube. The diameter must be sufficient to accomodate a large flow of oxygen under pressure sufficient to supply one oxygen recipient for each outlet valve. The holes 2 must be spaced a sufficient distance apart to allow easy access thereto and easy operation of the valves connected thereto. The length of the tube 1 will be determined by the number of outlet holes and by the need for easy portability. Preferably, the holes 2 in the tube 1 will be internally threaded (FIG. 2) to receive an externally threaded male portion of a valve (FIG. 4). These valves are connected so as not to interfere with the flow of oxygen to outlets more distant from the oxygen inlet(s) when they are opened or closed.

The valves attached at the holes 2 in the tube 1 may be very simple straight or elbow shaped valves (FIG. 4), or they may include constant flow selector valves (FIG. 5) for careful control of the amount of oxygen to be delivered to each individual recipient. Oxygen check valves can be used also. These or other different types of valve may be interchanged at will. Portable oxygen supply tanks 3 may be attached by a flexible member 4 at one or more of the valved openings, preferably only at one or two of the openings in order to provide the greatest possible number of oxygen delivery outlet valves. Each outlet valve is attached by a flexible connector 5 to an oxygen mask, tent, or similar medical oxygen applicator 6.

Each end of the tube is sealed off by a capping member 7. This capping member 7 is preferably tick welded into place (see reference numeral 8 in FIG. 3), though it may be permanently attached in any other manner which will preserve an airtight seal.

The tube-like body of the device bears a pair of mounting studs 9, one located near each end of the tube 1. These studs 9 extend downward from the bottom of the tube 1, and may be, but need not be, integral therewith. These studs 9 may support the device at a convenient distance off of the ground in any of several ways by use of various stands and/or mounts. For example, they may extend the entire distance to the ground, ending in broadly based feet 10 (for instance bipod, tripod or T-shaped feet), or they may extend only a short distance from the tube 1 and be designed so as to conveniently attach to a conventional stand or frame 11, for instance by insertion of the studs into the openings 12 in the frame 11.

While the above disclosure is intended to be complete, it is obvious that some modification may be made to the above design by those skilled in the art without departing from the scope and spirit of the invention. Therefore the present invention is not limited to the specific embodiment disclosed above, but extends also to any such modifications which are obvious to those skilled in the art.

What is claimed is:

1. A portable medical oxygen delivery system comprising at least one tube having spaced holes along one side of it adapted for the connection of valves thereto; valves connected to said holes; two legs, one extending from the bottom of said tube near each end thereof; the ends of said tube being permanently capped to form an airtight member; one or more of said valves being connectable to one or more portable supplies of oxygen, and at least one of the remaining valves being connected through elongated flexible members to medical oxygen applicators.

2. The system of claim 1 wherein said applicators are oxygen masks.

3. The system of claim 1 wherein said holes are internally threaded and said valves are connected thereto via an externally threaded male portion of the valves.

4. The system of claim 1 wherein one or two of said valves are connected to one or two portable oxygen tanks.

5. The system of claim 1 wherein the ends of said tube are permanently capped by caps tick welded into place.

6. The system of claim 1 wherein said valves are of the constant flow selector type.

7. The system of claim 1 wherein said valves include an oxygen check valve.

8. The system of claim 1 wherein each leg terminates in a foot which will firmly support the system.

9. The system of claim 1 wherein the legs are short and are adapted to connect to a conventional supportive framework.

10. The system of claim 1 wherein said holes are internally threaded and said valves are connected thereto via an externally threaded male portion of the valves, and one or two of said valves are connected to one or two portable oxygen tanks.

11. The system of claim 10 wherein said applicators are oxygen masks.

12. The system of claim 10 wherein the legs are short and are adapted to connect to a conventional supportive framework.

* * * * *